US005584409A

United States Patent [19]

Chemberlen

[11] Patent Number: 5,584,409

[45] Date of Patent: Dec. 17, 1996

[54] ONE DIRECTION VENTILATION VALVES

[76] Inventor: Christopher H. Chemberlen, 9931 Foxrun Rd., Santa Ana, Calif. 92705

[21] Appl. No.: 529,359

[22] Filed: Sep. 18, 1995

[51] Int. Cl.[6] ..... B65D 33/01; B65D 51/16

[52] U.S. Cl. ..... 220/89.1; 220/373; 220/374; 383/103

[58] Field of Search ..... 220/374, 373, 220/89.1; 383/103; 206/524.8

[56] References Cited

U.S. PATENT DOCUMENTS

| | | | |
|---|---|---|---|
| 793,107 | 6/1905 | Staunton . | |
| 2,214,346 | 4/1939 | Pim . | |
| 2,638,263 | 5/1949 | Jesnig . | |
| 2,821,338 | 1/1958 | Metzger | 383/103 |
| 3,083,861 | 4/1963 | Amberg et al. | 220/371 |
| 3,193,130 | 7/1965 | Miller | 220/374 |
| 3,595,467 | 7/1971 | Goglio . | |
| 4,000,846 | 1/1977 | Gilbert | 383/103 |
| 4,122,993 | 10/1978 | Glas . | |
| 4,134,535 | 1/1979 | Barthels et al. . | |
| 4,206,870 | 6/1980 | DeVries | 383/103 |
| 4,296,862 | 10/1981 | Armentrout et al. | 220/374 |
| 4,365,715 | 12/1982 | Egli . | |
| 4,653,661 | 3/1987 | Buchner et al. | 383/103 |
| 4,756,422 | 7/1988 | Kristen . | |
| 4,890,637 | 1/1990 | Lamparter . | |
| 5,024,538 | 6/1991 | Goglio | 383/103 |
| 5,263,777 | 11/1993 | Domke . | |
| 5,332,095 | 7/1994 | Wu . | |
| 5,354,133 | 10/1994 | Rapparini . | |

FOREIGN PATENT DOCUMENTS

| | | | |
|---|---|---|---|
| 1018740 | 10/1957 | Germany | 220/373 |
| 159385 | 6/1957 | Sweden | 220/373 |

*Primary Examiner*—Stephen P. Garbe
*Attorney, Agent, or Firm*—Frank J. Uxa

[57] ABSTRACT

Valves useful for pressure relief/ventilation/vacuum or pressure retention, particularly in packaging containers, are disclosed. The present valves include a first member which is substantially rigid, includes an outer sealing region and a raised section having at least one hole therethrough; and a second member which is substantially elastic, is in close proximity to, preferably in contact with, the raised section of the first member and is sealingly secured the first member at the outer sealing region. The second member includes at least one through hole located outwardly or outboard of the raised section of the first section and inwardly of the outer sealing region of the first member. The elastic member may be moved away from the raised section to equalize gas pressures between a container and the environment outside the container or is urged into more intimate contact with the raised section to prevent gas flow into or out of the container. The present valves are effective and reliable for repeated and/or long term use.

20 Claims, 3 Drawing Sheets

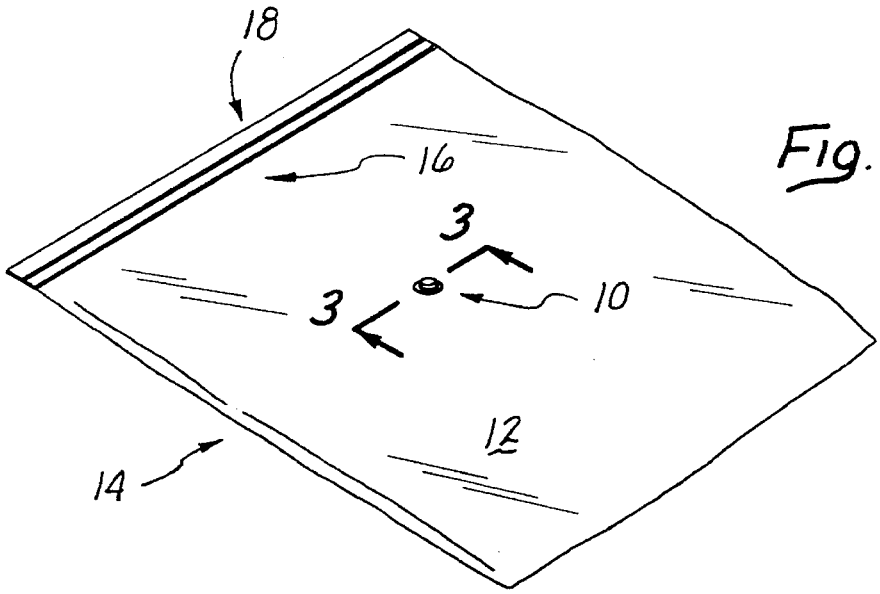
Fig. 1
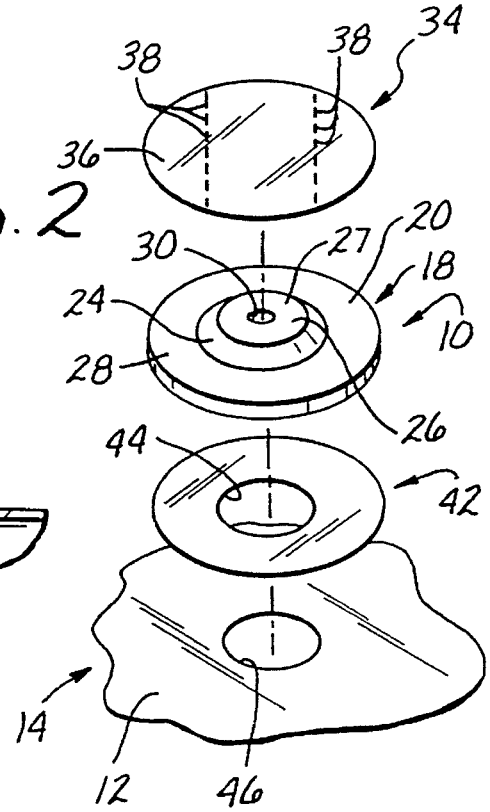
Fig. 2
Fig. 3
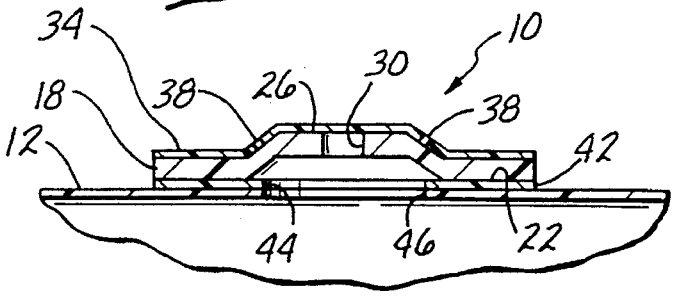
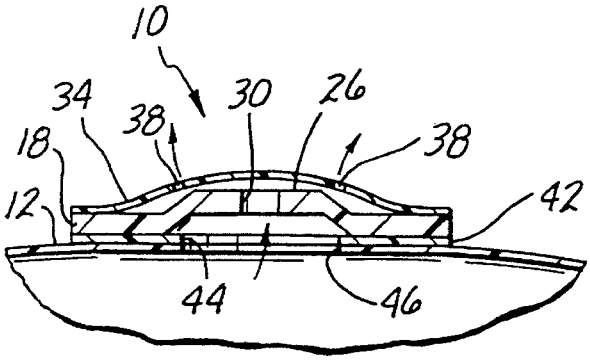
Fig. 4

ONE DIRECTION VENTILATION VALVES

BACKGROUND OF THE INVENTION

The present invention relates to one direction valves, for example, for containers. More particularly, the invention relates to one direction valves, and containers including such valves, for ventilation, and short term partial vacuum or pressure retention of or in an otherwise closed container, such as a packaging container.

Various one way valves for product packaging containers have been suggested by the prior art. Such valves are useful, and may even be required, to relieve pressure build-up in a packaging container, which build-up can occur during product storage, transportation and processing, for example, during cooking and the like. Also, such valves are advantageous in situations where it is desirable to maintain a limited degree of partial vacuum in a container for a short period of time. It should be noted that valves of the type discussed herein must be produced inexpensively in order to be competitive and commercially viable.

The prior art valves have suffered from one or more problems or disadvantages. For example, many of these valves include internal moving parts which make the valves difficult and/or expensive to manufacture and add an undesirable degree of complexity which tends to make the valves unreliable in operation, particularly in repeated or long term operation. Other previous valves have involved a very tortuous gas path though the valve. This also tends to make the valve unreliable in operation.

It would be advantageous to provide a one way valve for packaging containers which solves one or more of the problems apparent in the previous valves.

SUMMARY OF THE INVENTION

New valves for containers, and containers including such valves, have been discovered. The present valves are straightforward in construction, easy and inexpensive to mass produce and provide effective and reliable valving results and operation, even after repeated and/or long term use. The present valves include no internal moving parts. In fact, the only movement at all is a limited movement between valve elements which are mutually joined or sealed together. Also, the materials of construction of the present valves are readily available and relatively inexpensive. In addition, the construction or structure of the valves is such that the gas flow paths are not tortuous and are very effectively and reliably controlled (or valved) so that the desired effect is consistently achieved, even after repeated and/or long term opening and closing of the valves.

In one broad aspect of the invention, the present valves comprise a first member or valve seat and a second member or valve element. The valve seat is substantially rigid and includes an outer sealing region and a raised section which has at least one, and preferably only one, hole therethrough. The valve element is substantially elastic and is in close proximity to, preferably in contact with, the raised section of the valve seat. The valve element is sealed to the valve seat at the outer sealing region. At least one fluid passageway is located outwardly from the raised section and is adapted to allow relief of excessive fluid pressure in the at least one hole through the raised section.

In one embodiment, the valve element includes at least one through hole, preferably a plurality of through holes, located outwardly from the raised section and inwardly of the outer sealing region. In this embodiment, the valve seat and valve element are preferably sealed together at the outer sealing region of the valve seat, for example, at the outer peripheral surface of the valve seat, so that no gas passage or flow is allowed between the valve seat and valve element across the outer sealing region.

In another embodiment, at least one fluid passageway, and preferably a plurality of fluid passageways, pass across at least a portion of the outer sealing region. In this embodiment, the fluid passageway or fluid passageways can be considered to be one or more controlled breeches or imperfections in the sealing between the valve seat and valve element.

The present valves are preferably used on closed bags, boxes, cartons, trays, form-fill-seal (FFS) packaging containers, and flexible and rigid thermoform-fill-seal (TFFS) packaging containers, for example, such as those utilized for food, industrial and medical-type products and the like.

The valve may be attached, for example, externally or internally, to a wall of the container, for example, by heat fusion, by an adhesive bonding process or the like. This attachment is preferably accomplished at the same time or after a small opening is made in the container wall. In any event, an opening must be provided in the container wall and this opening must be completely covered by the valve seat or must be circumscribed by the outer sealing region of the valve seat.

The operation of the present valves is illustrated as follows. The valve, positioned externally on the wall of the container, operates by allowing a higher pressure gas, for example, air, to flow through the opening in the container wall and simultaneously through the hole or holes in the raised section of the valve seat when positive pressure is exerted on the interior of the container relative to the pressure on the exterior of the container. The high pressure gas elongates or moves the elastic valve element away from the raised section of the valve seat. This, in turn, allows high pressure gas to pass through the fluid passageway or passageways, for example, the through hole or holes in the valve element, to the environment outside the container. When the internal and external pressures have reached equilibrium, the elastic valve element returns to its original shape, and closes or seals around the hole or holes in the raised section of the valve seat, thereby preventing gas from flowing from outside the container to inside the container.

In another embodiment, the valve may be attached internally to the product container wall so that the opening in the wall is completely covered by the valve seat or is circumscribed by the outer sealing region of the valve seat.

In this embodiment, the valve preferably operates by allowing higher pressure gas to flow through the opening in the container wall and simultaneously through the hole or holes in the rigid valve seat, from the side opposite the valve element, when positive pressure is exerted on the exterior of the package container at the valve's position (relative to the pressure on the interior of the container). The high pressure gas elongates or moves the elastic valve element away from the raised section of the valve seat. This, in turn, allows high pressure gas to pass through the fluid passageway or passageways into the container. When the internal and external pressures have reached equilibrium, the elastic valve element returns to its original shape, and closes or seals around the hole or holes in the raised section of the valve seat, thereby preventing gas from flowing from inside the container to outside the container.

In a particularly useful embodiment, the raised section is provided in rigid lidding, for example, TFFS lidding, stock.

The second member or valve element can then be placed over the raised section and heat sealed or otherwise sealed to the lidding stock.

In addition, if desired, an adhesive, for example, a pressure sensitive adhesive, can be provided as a backing layer for attachment on the valve seat or first member.

The first member is preferably made of one or more polymeric materials. For example, the first member can be a single or multi-layer film component of one or more polymeric materials produced by extrusion, co-extrusion, lamination and the like. The rigid first member is provided with a raised section, for example, using conventional pressing techniques, and provided with one or more openings or apertures through the highest elevation of the raised section. The single or multiple openings or holes can be produced by conventional techniques, for example, such as a conventional punching operation.

The second member, which may be a single or multi-layer elastomeric film component, preferably made of one or more polymeric materials, is preferably stretched over the raised section of the first member. The second member preferably includes a plurality of through holes located outwardly or outboard from the raised section and inwardly of the region where the second member is sealed to the first rigid member. The second member preferably has sufficient elasticity so that an increase in pressure in the at least one hole through the raised section causes the second member to move relative to the first member to relieve the pressure through the at least one through hole in the second member. The second member is also sufficiently elastic so as to return to its original position relative to the first member once the pressure is relieved. The second member is preferably made of one or more elastomeric polymeric materials, for example, produced by extrusion, co-extrusion, lamination and the like. The through hole or holes in the elastic second member can be produced by various techniques, such as conventional techniques for producing perforations in polymeric films.

The second member may be in direct contact with the raised section of the first member. In one useful embodiment, the present valves further comprise a coating material located on at least one of the raised section and the second member. This coating material is effective to at least assist in preventing the unwanted flow of fluid, in particular gas, between the raised section and the second member. Any suitable coating material may be employed in accordance with the present invention. One very useful example of such a coating material is liquid silicone polymers which are resistant to evaporation, and are effective for preventing unwanted fluid flow while, at the same time, being substantially innocuous to a wide range of packaged products and packaging materials in containers employing the present valves.

The first member preferably includes a top surface and an opposing bottom surface, with the second member being located in proximity to the top surface. In one embodiment, the present valves further comprise an adhesive member secured to the bottom surface of the first member. This adhesive member is effective in attaching the valve to the container for use. Any type of suitable adhesive may be employed in accordance with the present invention. Examples include pressure sensitive adhesives, hot melt adhesives, ultraviolet (UV) light curable adhesives and the like. If an adhesive member is employed, it is preferably flexible and comprises a pressure sensitive adhesive or a hot melt adhesive.

It is also within the scope of the invention to provide that the valve is secured to the container or package wall by other means, for example, normal heat and/or pressure sealing, ultrasonic sealing, high frequency sealing, radio frequency sealing and the like.

In an additional embodiment, the present valves further comprise a cap member attached to the second member in an position opposite that of the raised section of the first member. The cap member is substantially gas impermeable and is effective to at least assist in preventing the unwanted flow of gas through the at least one hole in the first member. To illustrate, in a situation where the interior of the container is substantially in equilibrium with the environment outside the container, incidental flow of gas may occur across the second member into the container. The gas impermeable cap member is effective to reduce or even eliminate this gas flow and provides an additional degree of protection of the freshness and integrity of the contents of the container when the valve is to be operated, the cap member is structured so that it does not interfere with the movement of the second member or with the passage of gas through the through hole or holes in the second member.

Containers including the valves as described herein are included within the scope of the present invention.

Each of the individual features of the present valves and containers may be used individually or, unless expressly indicated otherwise or unless two or more features are inconsistent with each other, may be used in various combinations. All such features and combinations are included within the scope of the present invention.

These and other aspects of the present invention are apparent in the following detailed description and claims, particularly when considered in conjunction with the accompanying drawings in which like parts bear like reference numerals.

BRIEF DESCRIPTION OF THE DRAWINGS

FIG. 1 is an illustration, in perspective, of a flexible bag container including a valve in accordance with the present invention.

FIG. 2 is an exploded view, in perspective, of the valve shown in FIG. 1.

FIG. 3 is a cross-sectional view taken generally along line 3—3 of FIG. 1.

FIG. 4 is a cross-sectional view of the valve shown in FIG. 1 in use to relieve excess pressure from within the container.

DETAILED DESCRIPTION OF THE INVENTION

Figure 5:
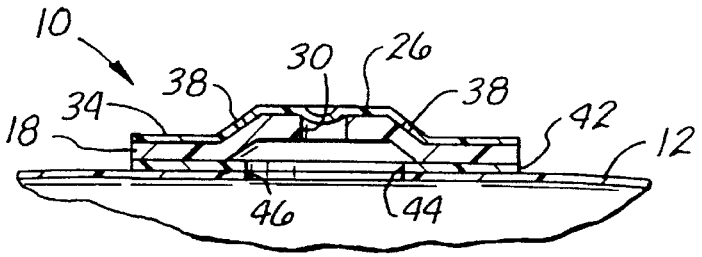
FIG. 5 is a cross-sectional view of the valve shown in FIG. 1 in use to maintain a partial vacuum in the container.

Referring now to the drawings, FIG. 1 illustrates an embodiment of the present valve, shown generally at 10, secured to the sidewall 12 of a bag container 14. The bag container 14 is made of a flexible polymeric material, such as polyolefin and the like, and is opened and closed by a conventional tongue and groove locking assembly, shown generally at 16, such as a conventional Zip-Lok® closure system. Thus, when it is desired to open bag container 14, the tongue and groove assembly 16 is disengaged to allow product from the interior of the bag container to exit the outlet 18. Similarly, when it is desired to close the outlet 18, the tongue and groove assembly 16 is engaged along its length, thereby closing the outlet and locking the interior of the bag container 14 from the environment outside the bag container.

Although the valve 10 is illustrated with regard to a reusable bag container 14, it should be noted that the valves in accordance with the present invention can be employed in conjunction with any suitable container, in particular any suitable packaging container for a product. Examples of such containers include bags, boxes, cartons, trays, FFS packaging containers, flexible and rigid TFFS packaging containers and the like, which can be utilized for a wide variety of products, such as food products, a multitude of different types of industrial products, medical type products and the like. The present valves are particularly useful in repeated and/or long term operation. Therefore, it is preferred that the container to which the valve is secured is reusable.

Referring now to FIG. 2, the valve 10 includes a rigid component 18, for example, a rigid film member, which includes a top surface 20, a bottom surface 22 (FIG. 3) a riser section 24 and a raised plateau 26 at the highest elevation above the peripheral portion 28 of the top surface. An elastic component 34 in the form of a circular disk is also provided. Rigid member 18 includes a centrally located hole 30 which passes from the raised plateau 26 through the rigid member 18 to and through the bottom surface 22. Rigid component 18 and elastic component 34 have generally circular configurations, as do the raised plateau 26 and the hole 30. However, it should be noted that other configurations can be used, and may be desirable depending on the particular application involved. Rigid component 18 and elastic component 34 may be of any suitable size. Preferably, these components have diameters in the range of about 0.3 inch to about 2 inches. The raised plateau 26 is preferably about 0.1 to about 0.5 inch in diameter and about 0.03 to about 0.3 inch above the top surface 20 of the rigid component 18 (at the peripheral portion 28).

Rigid component 18 may be made of any suitable material of construction, provided it has the desired degree of rigidity and is compatible, for example, with the application in which the valve is to be used, with the processing (e.g., packaging) methodology being employed, and with the container (and contained product) with which the valve 10 is to be used. Preferably, the rigid component 18 is made from a sheet or film of one or more polymeric materials, for example, produced by extrusion, coextrusion, lamination and the like. Examples of suitable materials of construction for the rigid component 18 include single layer structures made of polyvinyl chloride (unplasticized), high impact polystyrene, polypropylene, polyethyleneterephthalate, polycarbonates, acrylonitrile-methyl acrylate copolymers, acrylonitrile- butadiene-styrene copolymers and the like; and multilayer laminated or coextruded structures made of a core layer (for example, at least about 60% or at least about 70% or at least about 80% by weight of the total structure) of one or more of the materials listed above and one or more outer layers made of polyurethanes (ester or ether types), polyethylene of all densities, polypropylene, polyisobutylene, ethylvinyl acetate, thermoplastic elastomers, rubbers and the like.

Although not normally required, raised plateau 26 may be coated with a liquid silicone polymer, shown at 27, to enhance the operation/effectiveness of valve 10.

Elastic component 34 is sealed near its periphery 36 to the peripheral zone 28 of rigid component 18. This seal is complete and is not broken (is gas tight) under normal use conditions of valve 10. Elastic component 34 includes a series of perforations 38 which are located outboard or outwardly from the highest section of the raised plateau 26 of rigid member 18. The elastic component 34 is preferably stretched over the raised plateau 26 so that the elastic component is in intimate contact with the raised plateau and the perforations 38 extend outwardly beyond the periphery the raised plateau 26. It should be noted that with the elastic component 34 being unsecured to the rigid component 18, the perforations 38 may appear to be situated on top of the raised plateau 26. However, with the securing, and preferably stretching, of elastic component 34, these perforations 38 are always positioned outwardly of the highest section of the raised plateau 26.

Elastic component 34 can be made of any suitable material of construction having the desired degree of elasticity, for example, to allow the elastic component to move or extend away from the raised plateau 26 when necessary to relieve gas pressure from within bag container 14 and to return to its original configuration relative to rigid component 18 when the pressure differential has been relieved or equilibrated. Also, as with rigid component 18 and all other components of valve 10, elastic component 34 should be substantially compatible, for example, with the application in which the valve is to be used, with the processing (e.g., packaging) methodology being employed, and with the container (and contained product) with which the valve is to be used. It is preferred that the elastic component 34 be made of one or more elastomeric polymeric materials, for example, made from a sheet or film of one or more such materials produced by extrusion, coextrusion, lamination and the like. Examples of suitable materials of construction for flexible component 34 include single layer or multilayer (e.g., laminates or coextruded products) structures made of one or more of polyurethane (ester or ether types), very low or ultra low density polyethylene, polypropylene, polyisobutylene, ethylvinyl acetate, thermoplastic elastomers, rubbers and the like.

Although valve 10 can be heat sealed or otherwise affixed (without the need of adhesives) to the wall 12 of bag container 14, as shown in FIGS. 2 and 3, an adhesive component 42 is employed in the embodiment illustrated. Adhesive component 42 is adhered to the bottom surface 22 of rigid component 18. Adhesive component 42 includes a centrally located opening 44 which is substantially coaxial with the hole 30 in rigid component 18. Also, it should be noted that in order for valve 10 to work effectively, the wall 12 of bag container 14 to which the valve is secured must also include a through hole, such as through hole 46. Through hole 46 is completely surrounded and closed off by valve 10. That is, any gas which passes through hole 46 also passes through hole 30 of rigid component 18.

Adhesive component 42 may be made of any suitable, compatible adhesive material effective to secure valve 10 to wall 12 of bag container 14. Particularly useful adhesive materials include pressure sensitive adhesives, hot melt adhesives, various conventional adhesives and the like.

It should be noted that with or without the adhesive component 42, valve 10 can be secured to the wall 12 of bag container 14 by any suitable bonding technique, for example, heat sealing, ultrasonic sealing, radio frequency sealing and the like. In any event, valve 10 is secured to the wall 12 of bag container 14, for example, as shown in FIGS. 3, 4 and 5.

The operation of valve 10 is illustrated in FIGS. 4 and 5. When there is an excessive or high pressure in the interior of bag container 14, valve 10 operates as shown in FIG. 4. The excessive pressure from the interior of bag container 14 causes gas to pass through the holes 46, 44 and 30 and to urge elastic component 34 to move away from the raised plateau 26. As the elastic component 34 moves out of contact with the raised plateau 26, gas from the interior of bag container 14 is allowed to escape through hole 30 and perforations 38 to the atmosphere. In one embodiment, the perforations 38 are in the form of small slits in elastic component 34. The gas from bag container 14 acts to force these slits open so that the gas can escape, which relieves the excessive pressure in the bag container. As the pressure inside and outside bag container 14 equilibrates, elastic component 34 returns to its original position, as shown in FIG. 3, in contact with raised plateau 26. This operation of the valve 10 can be repeated many times and continue to be effective to provide pressure relief or ventilation. It is important that the elastic component 34 have sufficient elasticity to be effective for repeated use in this manner.

When it is desired to maintain a partial vacuum in the interior of bag container 14, valve 10 operates as shown in FIG. 5. With regard to FIG. 5, the relatively high pressure from outside the bag container 14 causes elastic component 34 to press more forcefully in on raised plateau 26 to block the passage of gas into hole 30. As shown in FIG. 5, the elastic component 34 actually is sucked partially into hole 30. Substantially no gas is allowed to penetrate hole 30 to enter into the interior of bag container 14. The reduced pressure or partial vacuum in the interior of bag container 14 is thus maintained for at least a short period of time.

Figure 6:
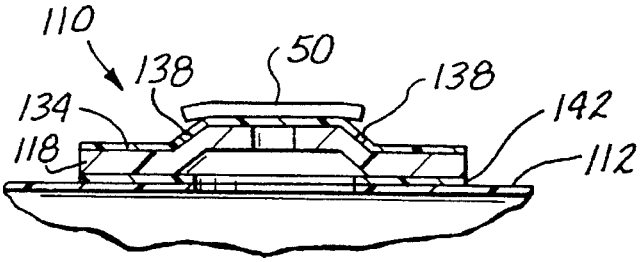
FIG. 6 is a cross-sectional view of an alternate valve in accordance with the present invention.

FIG. 6 illustrates valve 110, an alternate embodiment of the valve in accordance with the present invention. Except as otherwise expressly described, each of the components of valve 110 is identical to the corresponding component of valve 10 except that the reference numerals are increased by 100.

The primary difference between valves 110 and 10 is cap member 50, which is secured to elastic component 134 directly over raised plateau 126. Cap member 50 is substantially gas impermeable, for example, made of a gas impermeable polymeric material. Cap member 50 does not extend to or cover the perforations 138 in the elastic component 134. Cap member 50 functions to prevent any incidental passage of gas into or out of the interior of bag container 114, for example, when the valve 110 is at equilibrium (that is when the pressures inside and outside bag container 114 are equal). Cap member 50 also facilitates the use of valve 110 to maintain a partial vacuum within the interior of bag container 114. However, when there is an excessive pressure in the interior of bag container 114, cap member 50 does not prevent gas from flowing from the interior of bag container 114 through the perforations 138 in elastic component 134. In effect, cap member 50 is added insurance protecting the freshness or integrity of the contents within the interior of bag container 114.

Figure 7:
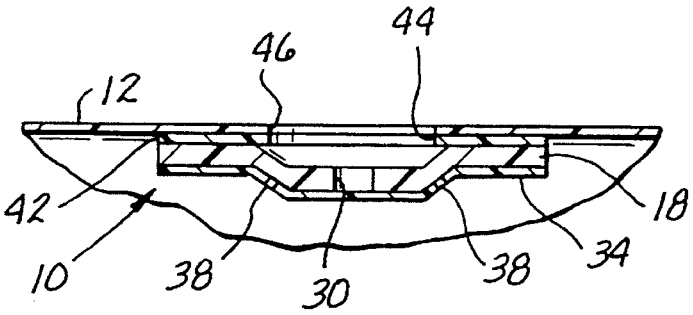
FIG. 7 is a cross-sectional view of a valve in accordance with the present invention shown attached to the inside of a container wall.

FIG. 7 illustrates an alternate placement of valve 10 on bag container 14. In FIG. 7, valve 10 is placed on the inside surface of wall 12 of bag container 14 (as opposed to the placement as illustrated in FIG. 1 where the valve is placed on the outside surface of wall 12). With the valve 10 placed as shown in FIG. 7, the valve is effective to equalize the pressure within the interior of bag container 14. For example, in situations where excessive pressure occurs outside of bag container 14, that excessive pressure is equalized using valve 10 so that gas from the space outside of bag container 14 passes through the perforations 38 in elastic member 34 into the interior of bag container 14. Also, a desired relatively high pressure within the bag container 14 can be maintained on at least a short term basis using the valve 10 placed as shown in FIG. 7.

Figure 8:
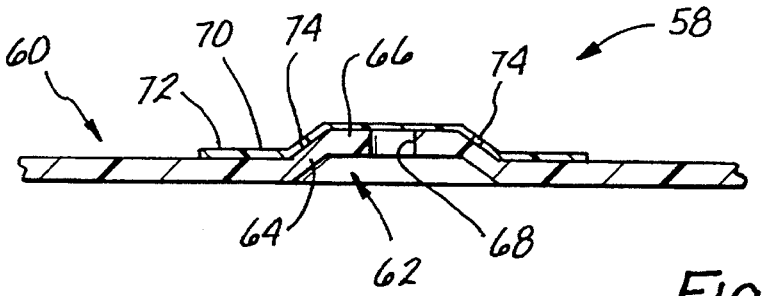
FIG. 8 is a cross-sectional view of a further embodiment of a valve in accordance with the present invention.

A further embodiment of a valve in accordance with the present invention is shown in FIG. 8. The valve, shown generally at 58, includes a segment of rigid TFFS lid stock, shown generally at 60, which is provided with a dome, shown generally at 62, which includes a riser section 64 and a raised plateau 66. A central hole 68 is provided in the raised plateau 66. An elastic component 70 is sealed near its periphery 72 to the lidding segment 60. Elastic component 70 includes a series of perforations 74 (similar in configuration to the perforations 38 described above) which are located outwardly of the raised plateau 66. Elastic component 70 is stretched over the raised plateau 66. The valve 58 shown in FIG. 9 can be used as part of the lid of a rigid packaging container and is effective as a pressure relief valve or ventilation valve or as a vacuum or pressure retention valve, substantially as discussed previously with regard to FIGS. 1 to 7.

Figure 9:
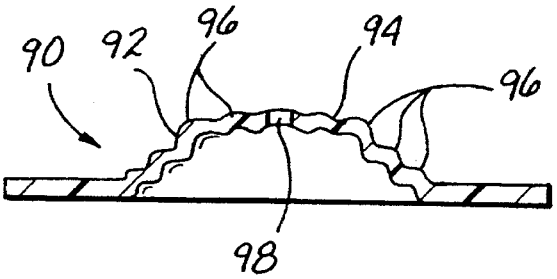
FIG. 9 is a cross-sectional view of another embodiment of a rigid component of a valve in accordance with the present invention.

FIG. 9 illustrates another embodiment of a rigid component, shown generally at 90, of a valve in accordance with the present invention. Except as otherwise expressly described, each of the elements of rigid component 90 is identical to the corresponding element of rigid component 18.

The primary difference between rigid components 18 and 90 is the fluted or ribbed structure of riser section 92 and raised plateau 94. These flutes or ribs 96 reinforce or add to the strength of rigid component 90, and in particular riser section 92 and raised plateau 94. Such enhanced strength is of value in at least assisting in maintaining the long term structural integrity of the valve of which rigid component 90 is a part. In addition, the enhanced strength is of value during the production, transportation and attachment (to a container) of the valve. It has been found that reinforcing structures, such as flutes or ribs 96, have no detrimental effects on the functioning of the valves, which functioning is substantially similar to the valves described elsewhere herein.

The flutes or ribs 96 can be oriented radially (or annularly) around centrally located hole 98. Alternately, the flutes or ribs 96 can extend longitudinally, for example, in substantially parallel rows. Also, the riser section and raised plateau of the rigid component can be reinforced by one or more other reinforcing structures which at least assist in enhancing the strength of the rigid component, provided that such structure or structures do not unduly interfere with the operation of the present valve.

Figure 10:
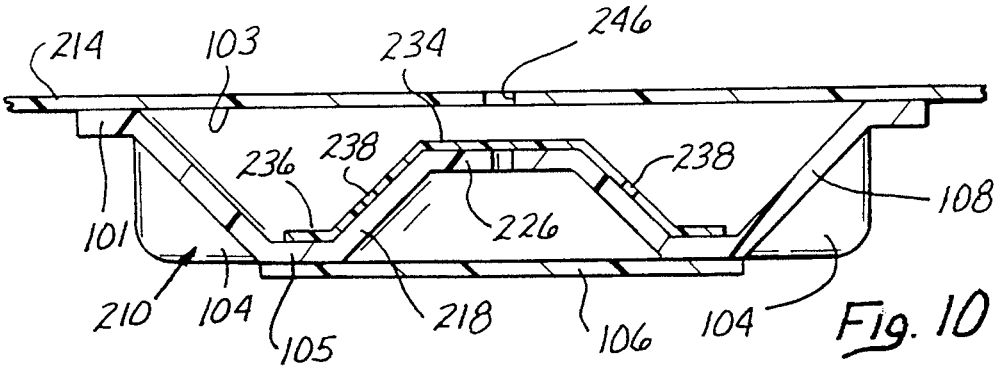
FIG. 10 is a cross-sectional view of an additional valve in accordance with the present invention shown attached to the inside of a container wall.

FIG. 10 illustrates valve 210, an additional embodiment of the valve in accordance with the present invention. Except as otherwise expressly described, each of the components of valve 210 is identical to the corresponding component of valve 10 except that the reference numerals are increased by 200.

The primary difference between valves 210 and 10 is annular peripheral zone 101 which is adapted to be bonded to bag container 214, for example, to the inside surface 103 of the bag container. Zone 101 is positioned at a higher elevation than is raised plateau 226 which allows the valve 210 to be bonded to the inside surface 103 while maintaining a spaced-apart relationship between the inside surface and the elastic component 234. The periphery 236 is attached to zone 105 of rigid component 218. Although zone 105 is not a peripheral zone it is outwardly disposed (or outer) relative to raised plateau 226. In addition, a layer 106 of porous filter medium, such as, spunbonded polyolefin, e.g., a material sold by Dupont under the trademark Tyvek®, is adhered to zone 105. If desired, filter layer 106 can be made larger and adhered to zone 101 so that the filter layer is located between bag container 214 and the remainder of valve 210. Filter layer 106 acts to prevent transference of contaminating particulates and/or organisms across the valve 210. Filter assemblies, such as filter layer 106, can be included in any valve in accordance with the present invention, particularly valves for medical applications. A plurality of radially extending ribs or flutes 104 produced in outer riser section 108 reinforce the structural integrity of rigid component 218.

With valve 210 secured to the inside surface 103 of bag container 214, as illustrated in FIG. 10, the valve is particularly effective in maintaining a partial vacuum within the container. Thus, with a partial vacuum inside container 214, elastic component 234 is pressed against raised plateau 226 to prevent gas, from outside the container, from entering the container through the valve 210. The gas outside the container 214, at about atmospheric pressure, exerts a force through through hole 246 in the container further urging elastic component 234 into contact with raised plateau 226. This further facilitates maintaining the partial vacuum inside of container 214.

Figure 11:
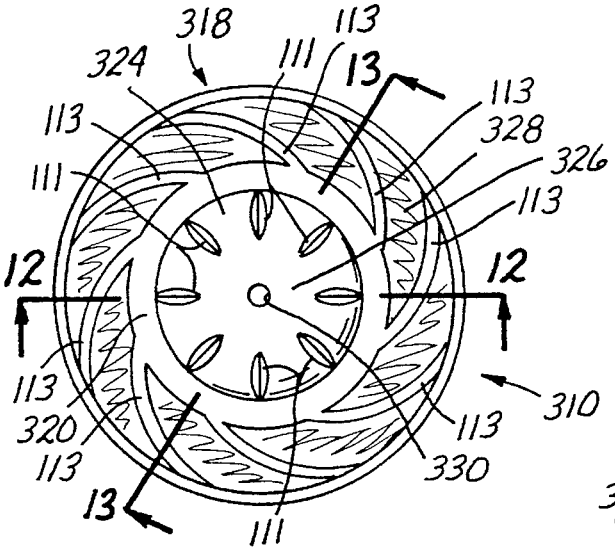
FIG. 11 is a top plan view of another embodiment of a valve in accordance with the present invention.
Figure 12:
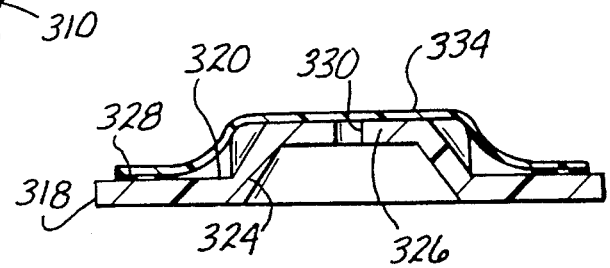
FIG. 12 is a sectional view taken generally along line 12—12 of FIG. 11.
Figure 13:
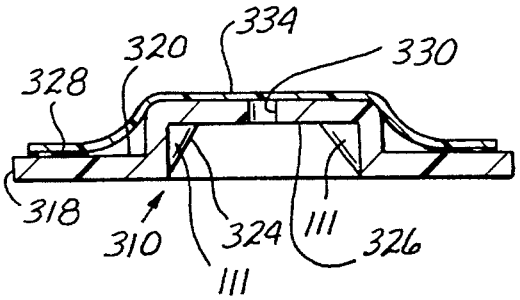
FIG. 13 is a sectional view taken generally along line 13—13 of FIG. 11.

FIGS. 11, 12 and 13 illustrate another embodiment of a valve, shown generally at 310, in accordance with the present invention. Except as otherwise expressly described, each of the components of valve 310 is identical to the corresponding component of valve 10 except that the reference numerals are increased by 300.

One primary difference between valves 10 and 310 is the fluted structure of riser section 324. Specifically, riser section 324 is formed with a plurality of radially extending flutes 111 which extend from the raised plateau 326 to the top surface 320. These radially extending flutes 111, which can be conventionally produced, for example, by punching or pressing techniques, during the manufacture of the rigid component 318, reinforce or enhance the strength and structural integrity of the rigid component, in particularly the raised portions of the rigid component.

In addition, elastic component 334 is secured to the top surface 320 of rigid component 318 at the peripheral portion 328 so that the seal between the rigid component and elastic component 334 includes fluid passages 113. In other words, the seal between the elastic component 334 and the rigid component 318 is formed so that a plurality of defined, curved fluid passages 113 exist. The elastic component 334 does not include perforations, such as perforations 38 in elastic component 34. Fluid passages 113 act as pathways through which excessive gas pressure in hole 330 can be relieved. Thus, instead of gas exiting the valve 10 through perforations 38, valve 310 operates by allowing gas to exit through fluid passages 113. Fluid passages 113 can be produced using conventional techniques, for example, by grooving a seal bar face or by using an adhesive layer cut to form the passages.

One advantage of the elongated fluid passages 113 of valve 310 is that they can be effectively used to control the performance of the valve. For example, by controlling the size and/or number and/or length of the fluid passages 113, the amount of pressure within a valved container required to "open" valve 310 can be varied and/or controlled. This feature, thus, allows users of the present valves to have substantial flexibility in selecting a valve having optimal characteristics for any given application.

Figure 14:
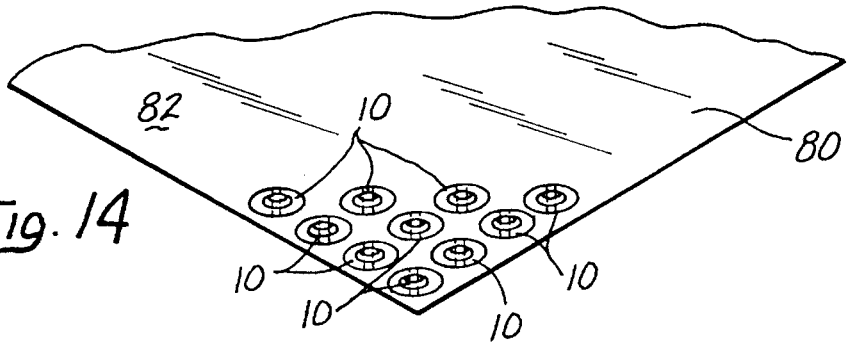
FIG. 14 is a somewhat schematic illustration showing a plurality of valves in accordance with the present invention as-they are mass produced.

FIG. 14 somewhat schematically illustrates a number of valves 10 directly after being mass produced. Thus, the individual valves 10 can be produced on a sheet 80 of a rigid material from which the rigid components of the valves 10 are derived. For example, the rigid sheet 80 is processed by passing it through a punch press, thermoforming machine or similar device which causes the riser sections 24, raised plateaus 26, and holes 30 to be formed. The elastic components 34 are then stretched over the rigid sheet 80 and raised plateaus 26 and sealed to the rigid sheet 80. A single unitary elastic sheet, provided with properly oriented perforations (from which perforations 38 are derived) can be placed in contact with the top surface 82 of rigid sheet 80 and then the seals between the individual elastic components and rigid components are formed. Also, if an adhesive component is to be used, a layer of suitable adhesive, with appropriately placed through holes, is applied to the opposing bottom surface of the rigid sheet 80. Finally, the valves 10 are cut from the rigid sheet 80 and are ready to be placed on a container, such as bag container 14.

The present valves are straightforward in construction, easy and inexpensive to mass produce and provide effective and reliable valving operation. The present valves include no internal moving parts, are effective when used repeatedly and/or on a long term basis and represent an important advance over the prior art.

While this invention has been described with respect to various specific examples and embodiments, it is to be understood that the invention is not limited thereto and that it can be variously practiced within the scope of the following claims.

What is claimed is:

1. A valve comprising:

a first member which is substantially rigid, includes an outer sealing region and a raised section having an area of highest elevation and at least one hole therethrough and being spaced apart from said outer sealing region;

a second member which is substantially elastic, is in contact with said raised section when said valve is closed and is secured to said first member at said outer sealing region; and a fluid passageway adapted to allow relief of excessive fluid pressure in said at least one hole, said fluid passageway comprises a through hole in said second member outwardly of said area of highest elevation and inwardly from said outer sealing region.

2. The valve of claim 1 wherein said raised section is centrally located on said first member, and has one hole therethrough.

3. The valve of claim 1 wherein said first member is a component of a container on which said valve is located.

4. The valve of claim 1 wherein said first member is made of at least one polymeric material, and said second member is made of at least one elastomeric polymeric material.

5. The valve of claim 1 wherein said second member is stretched over said raised section.

6. The valve of claim 1 wherein said second member is secured to said first member at said outer sealing region to form a substantially fluid tight seal.

7. The value of claim 1 wherein said fluid passageway comprises a plurality of said through holes.

8. The valve of claim 1 wherein said second member has sufficient elasticity so that an increase in pressure in the at least one hole through said raised section causes said second member to move relative to said first member so as to relieve the pressure through said at least one through hole in said second member and to return to its original position relative to said first member once the pressure is relieved.

9. The valve of claim 1 wherein said raised section includes at least one flute or rib to enhance the strength of said raised section.

10. The valve of claim 1 wherein said first member includes a top surface and an opposing bottom surface and said second member is located in proximity to said top surface, said first member further includes a peripheral zone having a higher elevation than said raised section, said peripheral zone being adapted to be secured to a container when said valve is in use.

11. The valve of claim 1 which further comprises a coating material located on at least one of said raised section and said second member and being effective to at least assist in preventing the unwanted flow of gas between said raised section and said second member.

12. The valve of claim 1 wherein said first member includes a top surface and an opposing bottom surface and said second member is located in proximity to said top surface, said valve further comprising an adhesive member secured to said bottom surface of said first member and being effective in attaching said valve to a container for use.

13. The valve of claim 1 which further comprises a cap member attached to said second member in a position opposite said raised section, said cap member being gas impermeable and being effective to at least assist in preventing the unwanted flow of gas through said at least one hole in said first member.

14. A container comprising:

a wall system defining a chamber, said wall system including a through hole;

a valve of claim 1 secured to said wall system so as to completely cover said through hole in said wall system, said valve being positioned so that said raised section extends away from the portion of said wall system to which said valve is secured.

15. The container of claim 14 wherein said valve is located outside of said wall system.

16. The container of claim 14 wherein said valve is located inside of said wall system.

17. A container comprising:

a wall system defining a chamber, said wall system including a substantially rigid portion with a sealing region and a raised section having an area of highest elevation and at least one hole therethrough and being spaced apart from said sealing region;

a substantially elastic member in contact with said area of highest elevation to prevent fluid from passing through said at last one hole, said substantially elastic member being secured to said substantially rigid portion at said sealing region; and a fluid passageway located outwardly of said area of highest elevation and adapted to allow relief of excessive fluid pressure in said at least one hole.

18. A valve comprising:

a first member which is substantially rigid, has a generally circular configuration and is made of at least one polymeric material;

said first member includes a centrally located raised section having a generally circular area of highest elevation and a hole therethrough and an outer sealing region circumscribing and spaced apart from said centrally located raised section;

a second member which is substantially elastic, has a generally circular configuration and is made of at least one elastomeric polymeric material;

said second member being stretched over said centrally located raised section, being in contact with said raised section when said valve is closed and being fluid sealingly secured to said first member at said outer sealing region; and said second member including a plurality of through holes located outwardly from said generally circular area of highest elevation and inwardly from said outer sealing region.

19. A valve comprising:

a first member which is substantially rigid, includes an outer sealing region and a raised section having an area of highest elevation and at least one hole therethrough;

a second member which is substantially elastic, is in contact with said raised section and is secured to said first member at said outer sealing region; and a fluid passageway adapted to allow relief of excessive fluid pressure in said at least one hole, said fluid passageway passing across at least a portion of said outer sealing surface.

20. The valve of claim 19 wherein said second member is stretched over said raised section.

* * * * *